United States Patent [19]

Sewell et al.

[11] Patent Number: 4,553,954

[45] Date of Patent: Nov. 19, 1985

[54] AUTOMATIC CASE ERECTOR AND SEALER

[75] Inventors: Peter C. Sewell, Vancouver; Gregory E. Rundle, Richmond; Karl L. Hanson, Abbotsford, all of Canada

[73] Assignee: Western Packaging Systems, Ltd., Richmond, Canada

[21] Appl. No.: 532,824

[22] Filed: Sep. 16, 1983

Related U.S. Application Data

[63] Continuation of Ser. No. 255,095, Apr. 17, 1981, abandoned.

[51] Int. Cl.[4] ..... B31B 5/02

[52] U.S. Cl. ..... 493/309; 493/122; 493/130; 493/131; 493/183

[58] Field of Search ..... 493/122, 126, 127, 183, 493/309, 310, 162, 130, 131

[56] References Cited

U.S. PATENT DOCUMENTS

| | | | |
|---|---|---|---|
| Re. 27,631 | 5/1973 | Berney | 493/131 |
| 2,699,710 | 1/1955 | Vahle | 493/162 |
| 2,745,323 | 5/1956 | Monroe et al. | 493/183 |
| 3,013,477 | 12/1961 | Meyer | 493/122 |
| 3,312,154 | 4/1967 | Pierce | 493/131 |
| 3,421,415 | 1/1969 | Pearson | 493/183 |
| 3,435,738 | 4/1969 | Berney | 493/162 |
| 3,695,151 | 10/1972 | Caron | 493/183 |
| 3,748,972 | 7/1973 | Barton | 493/126 |
| 3,796,141 | 3/1974 | Mueller | 493/310 |
| 4,235,159 | 11/1980 | Johnson, Jr. et al. | 493/130 |
| 4,273,322 | 6/1981 | Ginther, Sr. et al. | 493/122 |
| 4,348,853 | 9/1982 | Morse et al. | 493/122 |

*Primary Examiner*—Nicholas P. Godici
*Assistant Examiner*—Kurt Rowan
*Attorney, Agent, or Firm*—Lane & Aitken

[57] ABSTRACT

An automatic case erector and sealer apparatus useful in the erecting of packaging cases, boxes and cartons from flats, utilizing case puncturing and gripping pins, spraying adhesive onto the interior surfaces of the case flaps, while the flaps are in a semi-open position, and sealing the minor and major flaps of the erected flats with compression to thereby secure the major and minor flaps for subsequent filling of the formed case, box or carton with consumer goods.

31 Claims, 35 Drawing Figures

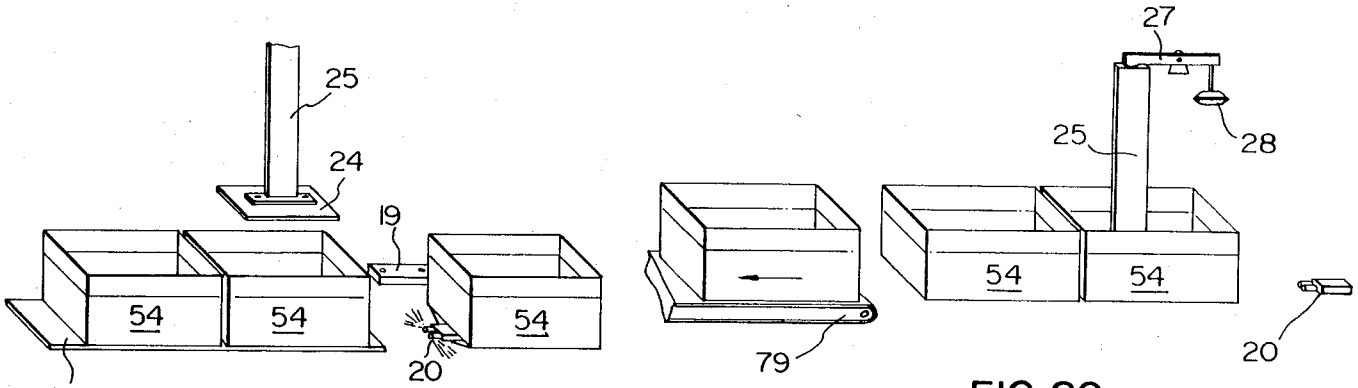
FIG. 19
FIG. 20
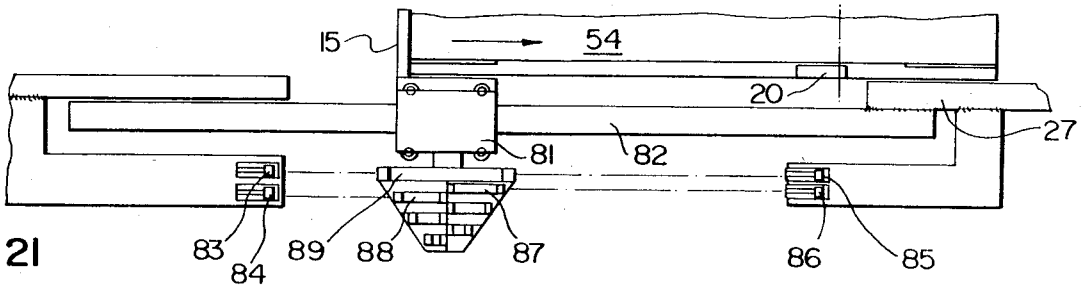
FIG. 21

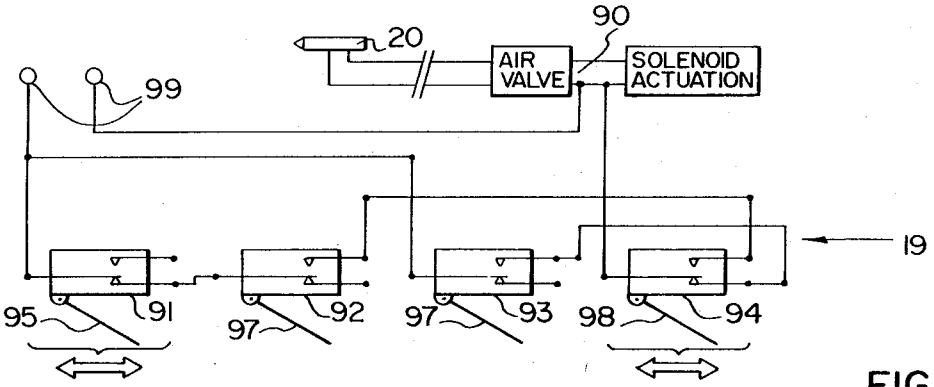
FIG. 22
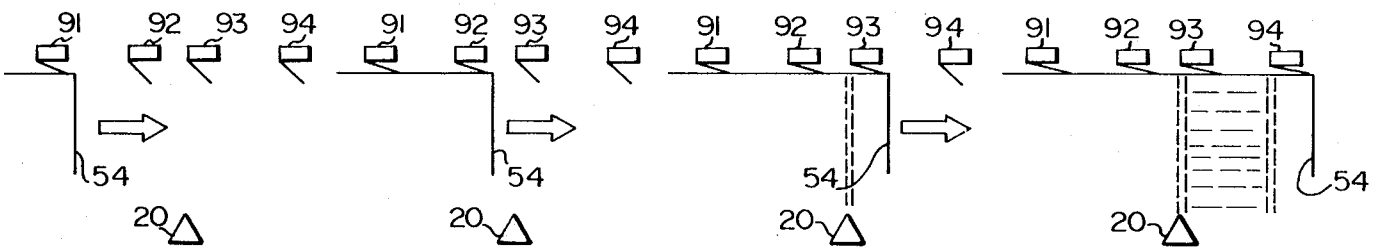
FIG. 23
FIG. 24
FIG. 25
FIG. 26

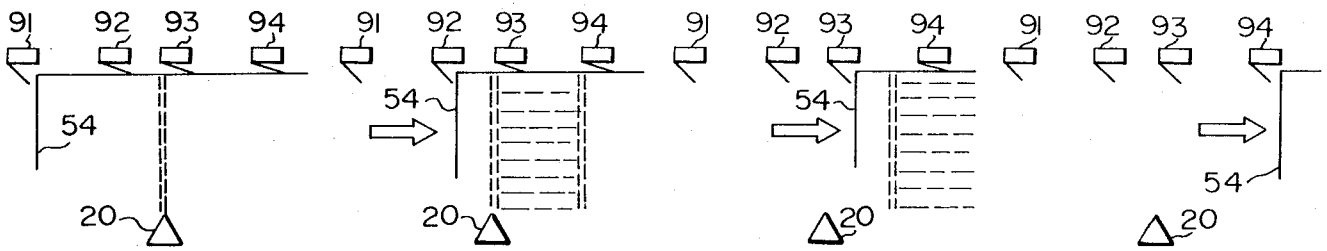
FIG. 27
FIG. 28
FIG. 29
FIG. 30
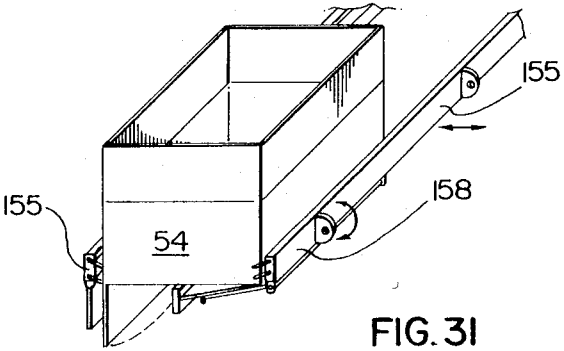
FIG. 31
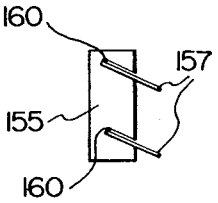
FIG. 31a

AUTOMATIC CASE ERECTOR AND SEALER

This application is a continuation of application Ser. No. 255,095, filed Apr. 17, 1981, now abandoned.

FIELD OF THE INVENTION

This invention is directed to an automatic case erector and sealer apparatus useful in the erecting of packaging cases, boxes and cartons from flat case, sealing the minor and major flaps of the erected case flats with adhesive and compression securing the major and minor flaps for subsequent filling of the formed case, box or carton with various types of consumer goods.

BACKGROUND OF THE INVENTION

Automatic case erector and sealing methods and apparatus now available in the marketplace, in order to cope with box speeds of 20 to 40 per minute, are long in length, and hence space consuming, generally complicated to operate, expensive, and use only hot melt adhesive systems for sealing the erected boxes. The case erecting and sealing systems now available and in use in particular suffer from a number of specific disadvantages which are discussed in some detail below.

Hot melt adhesives are much more expensive than and not as strong as cold cure adhesives.

Long case erector and sealer lines are expensive because they take up large amounts of expensive and valuable heated and weather protected space.

Currently available case erector and sealer apparatus are generally of high cost, complicated to operate, subject to frequent breakdown and expensive maintenance costs.

The suction cups used in conventional systems are subject to losing suction due to uneven case surfaces, score or crease lines, slots, dust pick-up and debris that may be found in normal case erecting environments.

Suction cup case erecting systems used in conventional case erecting equipment are somewhat delicate to operate and do not permit the cases to be moved rapidly about. This is because the inertia inherent in a typical case flat causes suction action used to grip the flat to be readily broken if the case is moved quickly from a standing position and quickly returned to a standing position.

Case erecting systems using suction cups, because of their delicacy, frequently fail to function and case erecting lines moving at 10 to 40 cases per minute must be shut down as soon as one case slips out of place. Following cases on the line quickly pile up, and consequently, the line must be stopped while the cases are placed back in position, all of which results in costly down time for the case erecting system.

Vacuum cup grips used in case flat erection to pull both sides of the case into a concave configuration, particularly cases made of recycled cardboard, which concave configuration tends to cause line jamming problems when the case enters the sealing stage of the case processing line.

The dust collected by suction cups must be filtered out of the suction system thereby creating considerable nuisance and expense. Further, if the filters are not cleaned or changed at appropriate intervals, suction systems lose vacuum and the line must be shut down.

Vacuum cup case handling lines have difficulty handling undesirable "wash boarding" (the corrugated cardboard core imprints through the outer sheets) on the surfaces of cases that are manufactured of corrugated cardboard made of recycled Kraft paper (which tends not to be as strong as virgin Kraft paper used in North America).

Case erecting systems using vacuum cups cannot tolerate a substantial amount of downward or upward force on the cases. Since considerable force is required to bend the major and minor flaps of an erected case under the case, it is not uncommon for cases to break away from the suction cups when the cases are lowered onto or struck by the flap tuckers.

Conventional case erecting systems, in order to enable the major and minor flaps of the cases to be secured by adhesive, must be completely opened, and then completely closed, thereby necessitating lengthy case erecting lines to carry out these operations.

Adhesive applicator systems used in conventional case erecting and sealing lines are heavy, bulky, and expensive, cannot operate effectively in confined spaces and can only handle hot melt adhesives at the speeds of today's case erecting lines.

Conventional case erecting and sealing apparatus use substantial quantities of expensive hot melt adhesive, and consume large quantities of valuable energy in order to function.

Conventional case erecting lines are noisy, dusty, and become adhesive laden because of stray droplets of adhesive that miss the flaps of the cases and collect on the various pieces of equipment, and in the case of hot glue, cause stringing or webbing.

The large distances customary with conventional case erector and sealing lines necessitates cases being moved through substantial distance which is energy inefficient.

The adhesive systems used in conventional case sealing lines tend to create rebound from the flaps onto the spray head and free floating adhesive droplets, thereby tending to clog the nozzles of the spray head, and creating irregular spray patterns which cause sealing problems for the case sealing line.

Conventional case erector and sealing systems require $\frac{1}{2}$ hour to $\frac{1}{2}$ day down time in order to set them up for a second size of case following processing of a first size of case.

SUMMARY OF THE INVENTION

The case erecting apparatus and system of the subject invention uses a pin and dome picking or board gripping system for erecting rectangular cases from corrugated cardboard flats. The pin and dome combination is far superior to the conventional suction cup system and permits cases to be handled more rapidly and surely than is now possible with conventional case erecting lines. This pin and dome system simplifies the actual case erection process dramatically and improves the reliability of the case erection process.

The system has a number of significant advantages:

(1) The pin and dome system reliably holds the case by the pins penetrating the extreme edges of the corrugated case flats. This system avoids failures when the corrugated edge of the flat is presented to the pins in damaged condition.

(2) The domes are offset to each other thereby causing the corrugated box to assume a snake-like (sine-wave) configuration through the domes. This enables the pins to reliably puncture the edges of the case flat and hold the flat in an accurate position as it is tensioned over the individual domes. It also enables a reasonable range of different thicknesses of corrugated cases to be run without adjustment.

(3) The pin and dome system enables the rapid erection and accurate placement of a corrugated case into the forming section of a corrugated case erecting machine. Compensation can be readily made for unsquare cases, poor quality cases and different thicknesses of cases.

(4) One adjustment of the pin and dome combination suits many sizes. However, if case sizes are particularly large, end dome sections can be added to the erector jaws to carry greater weights or greater widths.

Major and minor flaps of the erected case are adhesively secured by means of cold adhesive using a specially designed spray applicator that is capable of working within confined spaces and spraying adhesive on the insides of the two major or minor flaps of the case without having to open the flaps of the case completely, as is now required in conventional case erecting equipment. This procedure shortens the case erecting line by approximately two valuable box lengths.

The system also utilizes a novel random glue switch apparatus that automatically determines the leading and trailing edges of cases on the line and determines thereby when adhesive should be applied to the interior surfaces of the case flaps.

The present system is based on the concept of adhesive spraying sideways (laterally) using a unique adjustable rotatable nozzle. This makes it possible to spray inside the 1½ inch case flap gap without adhesive bounce back onto the spray head, which bounce back would degrade the efficient operation of the spray head.

Some of the advantages of the subject system are listed as follows:

(1) The device eliminates approximately two case lengths in case erecting machine length by the elimination of the necessity to fully open the flaps of the case to apply adhesive to the interior surfaces of the flaps.

(2) The device enables the spraying of adhesive to be done inside the closed case flaps thereby dramatically reducing the amount of free adhesive spray floating in the air. Such adhesive tends to land on non-related mechanical parts causing mechanical failure.

(3) The glue nozzles are rotatable through 360° and thereby provide a very high degree of flexibility.

(4) Because the air blows at right angles to the fluid adhesive spray emission in very close proximity to one another, a wide spray pattern can be obtained by employing an acute strike angle through the spray and at the same time a high degree of tip cleanliness is possible giving efficient clean performance and a high repeatability to the specific adhesive pattern.

(5) The glue head can be used for case bottom sealing, case top sealing or any sealing application where a consistent spray pattern of fine or variable adhesive atomization is required, at close quarters.

The invention is directed to an automatic case erecting and sealing apparatus which comprises (a) means for receiving and raising a case flat from a supply of case flats; (b) pin means for penetrating the case flat, thereby gripping same; and (c) means for causing the pin means to open the case flat.

The invention is directed to an apparatus for gripping and erecting case flats, taken from a magazine of case flats, comprising (a) at least a pair of sharp, pointed pins, one mounted on one support means, the second mounted on a second support means, the two support means being pivotally arranged in association with one another whereby the two support means can move from a closed position where the two support means are parallel to one another, to a position where the two support means are at right angles to one another; and (b) injector means for removing one case flat from the case flat magazine and forcing two of the edges of the case flat onto the pins, one edge being forced upon the sharp point of the first pin means, and the second edge being forced upon the sharp point of the second pin means.

The adhesive spray apparatus comprises (a) adhesive nozzle means for spraying liquid adhesive; and (b) air nozzle means mounted proximate to and at right angles to the direction of adhesive emission from the adhesive nozzle spray means whereby adhesive emitted from the adhesive nozzle is caused by air emitted from the air nozzle to spray at right angles to the nozzle.

The invention has a random glue switch sequencer for use in a case erecting and sealing apparatus comprising at least two switches, the switches having sensors mounted thereon, the sensors being capable of detecting the leading and trailing edges of objects as they pass by the switches, the pair of switches, upon being activated by the sensors, respectively emitting an electrical signal by being connected to an electrical power source, and a sensor activating means associated with the orientation of the case, whereby the case, upon being moved along the apparatus, moves the activating means, which in turn triggers the sensor of the switch.

The invention is directed to a method of holding and erecting a rectangular shaped case from a case flat comprising (a) ejecting the case flat in a manner such that two of the leading edges of the case flat are impinged respectively upon at least two sharpened pins, one of the pins being mounted on a first support means, and the second of the pins being mounted on a second support means, the two support means being parallel to one another, with the first and second pins on the first and second support means facing one another, the first and second support means being pivotally movable in relationship to one another; and (b) the two leading edges of the case flat once being respectively impinged and gripped on the first and second pin means, being pivotally opened from the parallel closed position of (a) to a position where the sides of the cases are at right angles to one another, by pivotally opening the first pin support means and the second pin support means so that they are at right angles to one another.

The invention is directed to a method of adhesively sealing the major and minor flaps of an erected case by spraying cold liquid adhesive on the interior surfaces of the major and minor flaps of the case while the major flaps are in only a slightly raised position, by utilizing a liquid adhesive spray means that can penetrate into the space between the slightly raised major flaps and closed minor flaps of the case body and spray liquid adhesive onto the interior surfaces of the major and the exterior surfaces of the minor flaps of the case.

The invention is directed to a method of spraying the interior surfaces of the major flaps and the exterior surfaces of the minor flaps of an erected case comprising (a) first electric sensing means being capable of detecting the leading edge of a case as it moves laterally past the first electric switching means; (b) a second electric sensing means arranged in a path with the first electric sensing means parallel to the path of travel of the case, the second sensing means being capable of detecting the leading edge of the case as it moves laterally past the second electrical sensing means; (c) a third electric sensing means arranged in a path with the first and second electric sensing means, parallel to the path of travel of the case, the third sensing means being capable of detecting the leading edge of the case as it moves laterally past the third sensing means, the third sensing means being connected to an electrical power supply, the third sensing means sending an electrical signal to a solenoid which upon receiving the signal actuates an air valve which in turn actuates a liquid adhesive spray means which commences to spray adhesive upon the interior surfaces of the major and the exterior surfaces of the minor flaps of the case; (d) a fourth electrical sensing means arranged in a path with the first, second and third electrical sensing means parallel to the path of travel of the case, the fourth electrical sensing means being capable of detecting the leading edge of the case as it moves laterally past the fourth sensing means; the fourth sensing means being connected to an electrical power supply and upon sensing the leading edge of the case, emits an electrical signal to solenoid which de-activates the solenoid, which in turn stops further spraying of liquid adhesive on the interior surfaces of the major and the exterior surfaces of the minor flaps of the case; (e) the first electrical signal (a), upon detecting the trailing edge of the case as it moves laterally by the row of electrical sensors, being connected to an electrical power supply source, emitting a signal to the solenoid thereby causing the solenoid to activate an air valve, which in turn causes the adhesive head to spray adhesive on the interior surfaces of the major and the external surfaces of the minor flaps of the case at a second location; and (f) the second electrical sensor (b) upon detecting the trailing edge of the case as it moves laterally by the row of electrical sensors being connected to an electrical power supply source, emitting a signal to the solenoid, which thereby de-activates the solenoid, and in turn stops the spraying of adhesive upon the major and minor flaps of the case.

DRAWINGS

Figure 9:
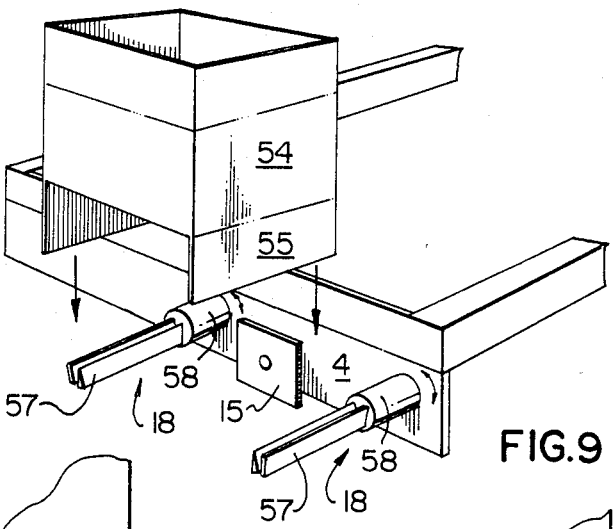
FIG. 9 represents a perspective view of the flap turning and hold down mechanism.
Figure 9A:
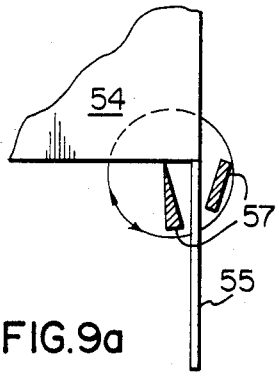
Figure 9B:
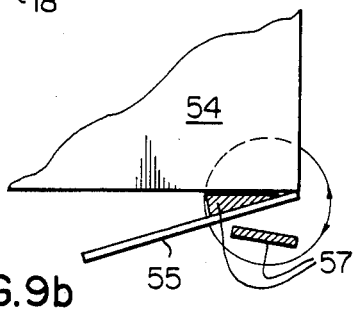
Figure 10A:
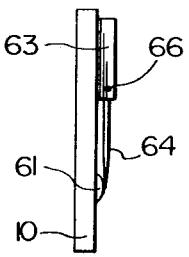
Figure 10:
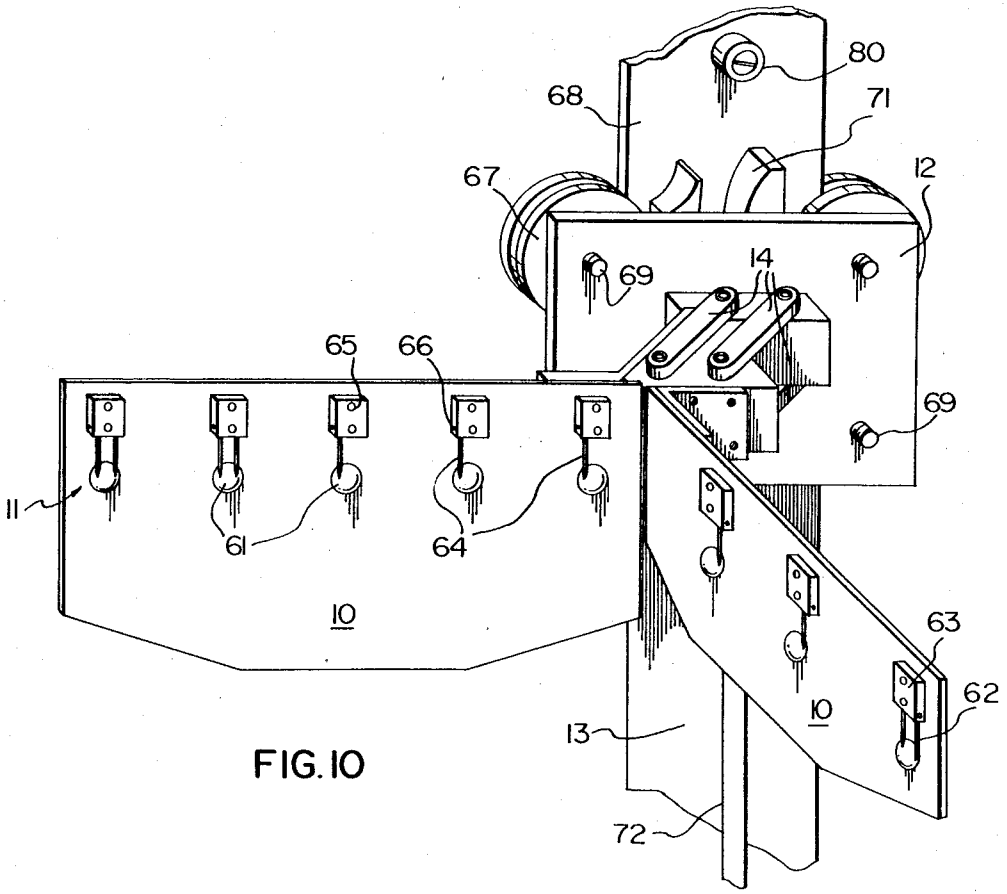
Figure 11:
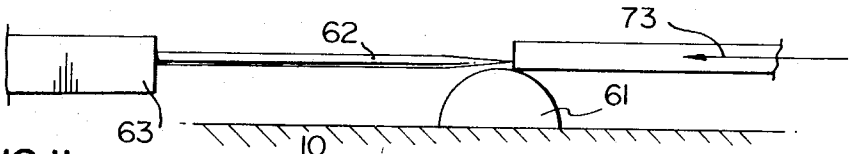
Figure 12:
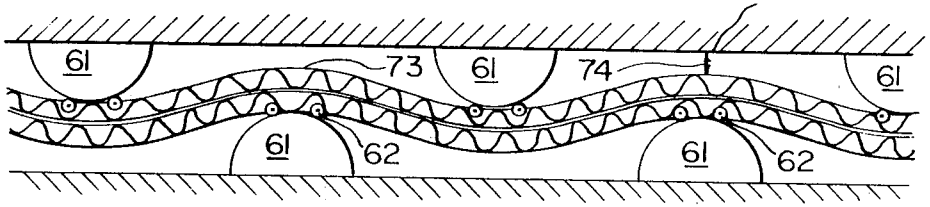
Figure 13:
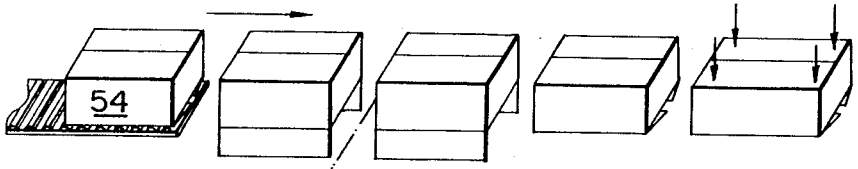
Figure 14:
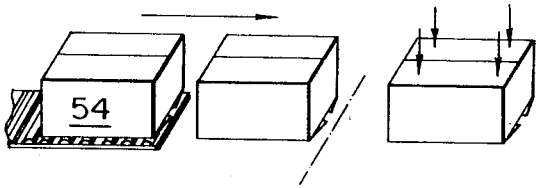
Figure 15:
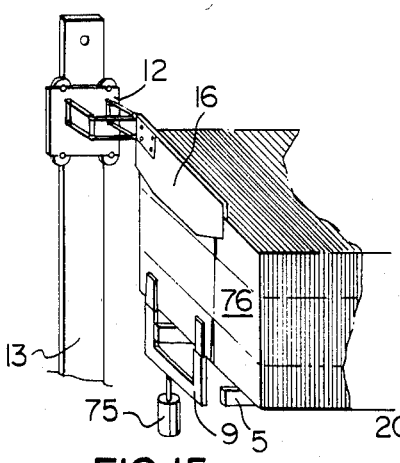
Figure 16:
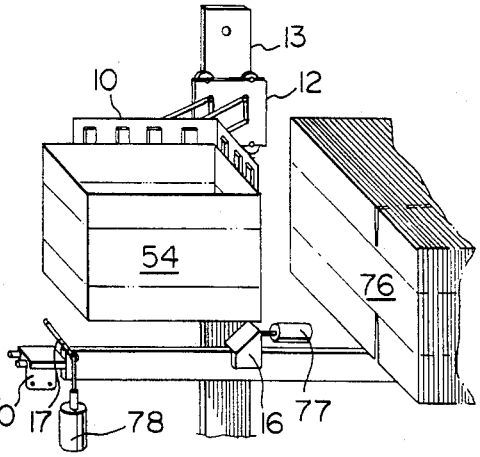
Figure 17:
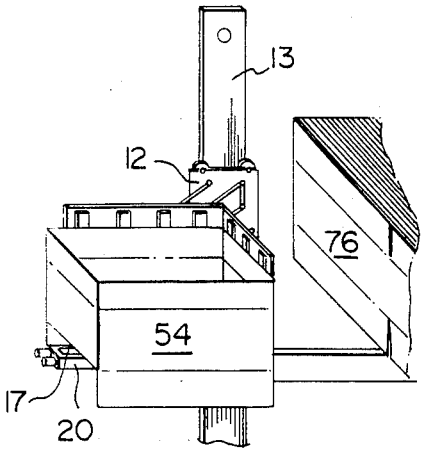
Figure 18:
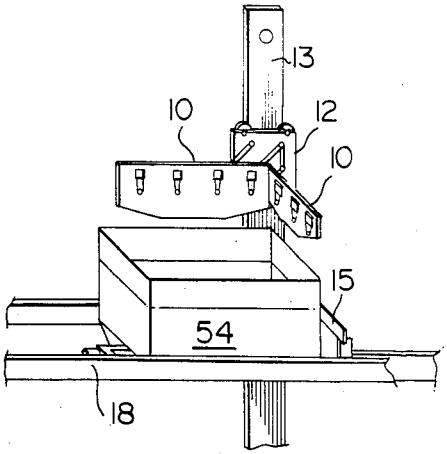

FIG. 9*a* represents an end view of the flap turning and nold down mechanism with flap extending downwardly;

FIG. 9*b* represents an end view of the flap turning and hold down mechanism with flap turned inwardly and upwardly;

FIG. 10 represents a perspective view of the box erector jaws and mounting assembly;

FIG. 10*a* represents an end view of the case erector jaw with pin and dome combination thereon;

FIG. 11 represents a side elevation view of the pin and dome combination aligned with the end of a corrugated cardboard piece;

FIG. 12 represents an end elevation view of a corrugated cardboard piece fitting between alternating dome and pin combinations mounted on two parallel disposed case erector jaws;

FIG. 13 represents sequential depiction of the case erecting and gluing procedures that are followed in a conventional case erecting line;

FIG. 14 represents sequential depiction of the case erector and gluing procedures that are followed in the subject invention;

FIGS. 15 through 18 represent sequential views of the base erecting procedure. FIG. 15 represents a perspective view of the procedure by which a box flat is injected upwardly onto the pins of the erector jaws;

FIG. 16 represents a perspective view of the procedure by which the box flat is opened and moved away from the magazine of flats by means of the erector jaws;

FIG. 17 represents a perspective view of the procedure by which the minor flaps of the case are tucked;

FIG. 18 represents a perspective view of the procedure by which the major flaps of the case are tucked;

FIG. 19 represents a perspective view of three cases on the process line, the major flaps of one case being sprayed by a glue head, the second case being moved in position under the compression platen, and the third case having been moved further along the line;

FIG. 20 represents a perspective view of the procedure by which the compression platen is lowered into the interior of one erected case to thereby seal the major and minor flaps of the erected case together.

FIG. 21 represents a side elevation view of an air and glue switch system with automatic case size adjustment;

FIG. 22 represents a schematic illustration of an alternative design of random glue switch with late and early skip gap timing; and FIGS. 23 to 30 represent sequentially the operation and timing of the glue switch as it is contacted by a moving case.

FIG. 31 represents a perspective view of an erected case resting upon a portion of the automatic erector and sealer;

FIG. 31*a* represents an end elevation view of a transit control bar;

DETAILED DESCRIPTION OF SPECIFIC EMBODIMENTS OF THE INVENTION

Figure 1:
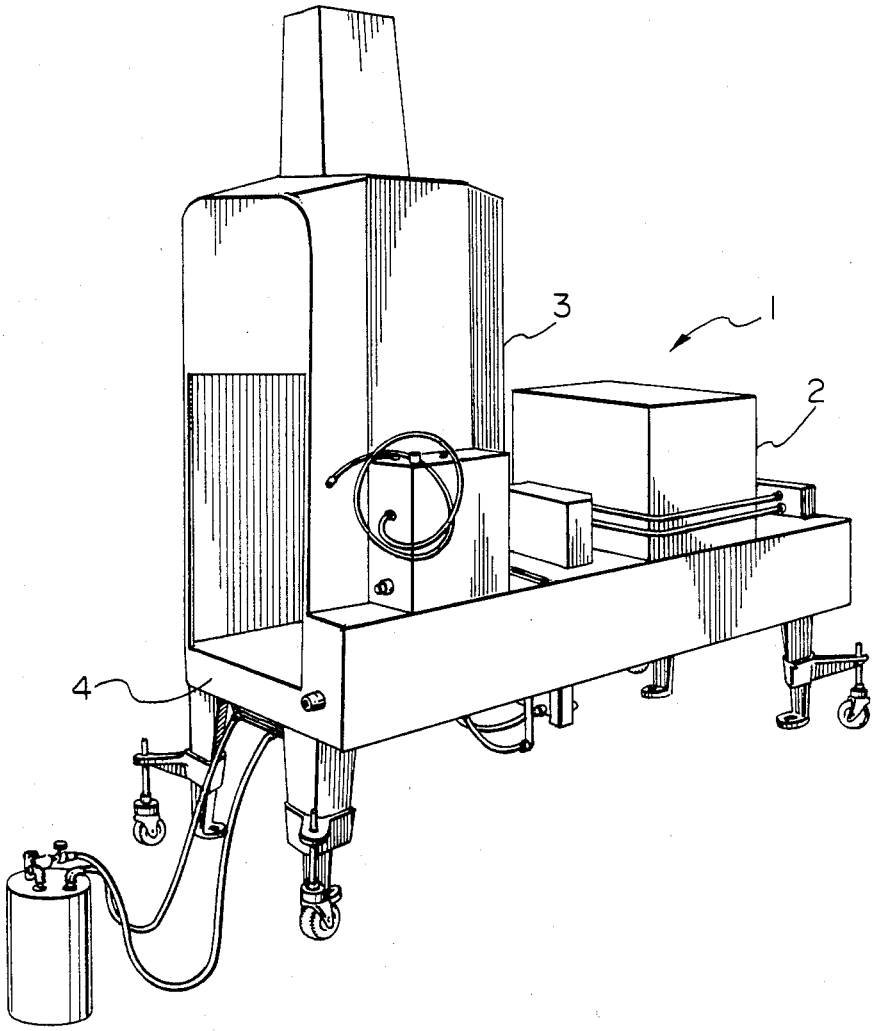
FIG. 1 represents a perspective view of the automatic case erector and sealer.

As can be seen in FIG. 1, the automatic case erector and sealer 1 is notable for its compact size and efficient construction, considering the number of operations that must take place in erecting a case from a flat and gluing it in erected form. The magazine of box flats 2 is shown at the right side of the erector and sealer 1. The spraying and sealing operations of the automatic case erector and sealer are housed in a hood 3, constructed of suitable metal or fibreglass. The hood 3, and the magazine of case flats 2 rest on a strong frame 4.

The magazine has, in effect, infinite length because of its edge—or case flat arrangement (contrasting to vertical hoppers). Thus, one can vary the length of the magazine to hold, for example a ½ hour, or many hours, supply of case flats.

Figure 2:
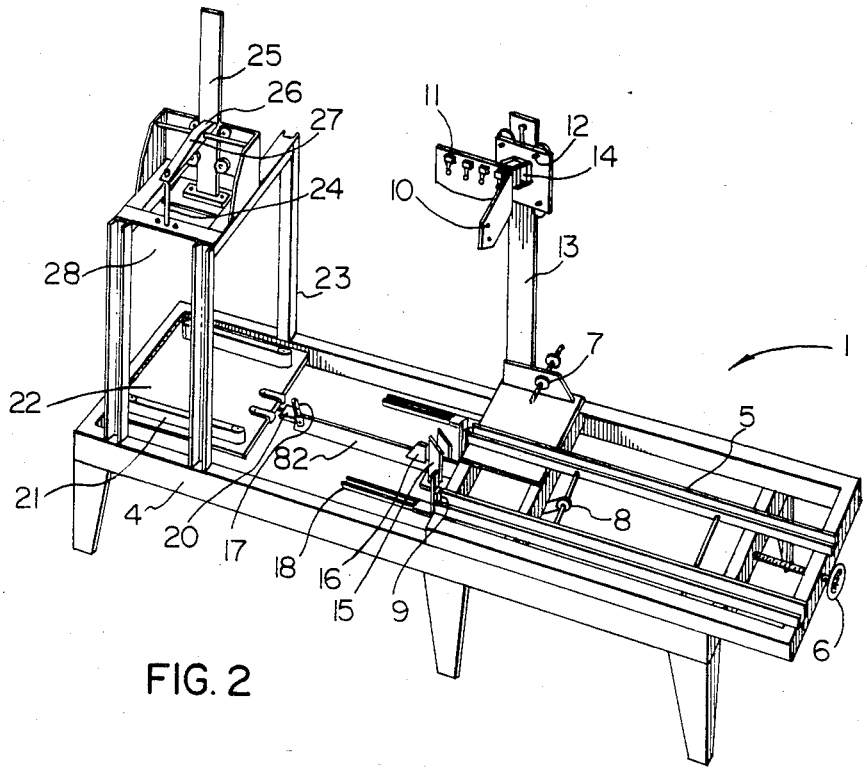
FIG. 2 represents a perspective view of some of the components and framework of the automatic case erector and sealer.

FIG. 2, illustrates a perspective view of the framework and various components of the case erector and sealer 1. The case flats are placed on a walking track 5, which advances the horizontal stack of case flats to the left.

The frame bearing the walking track 5 can be adjusted to accommodate different case (box) lengths by case length adjusting handle 6. The frame can be adjusted to accommodate various widths of boxes by case width adjusting handle 7.

The walking track 5 is driven by a walking track drive 8, which, by means of an eccentric mechanism, causes a pair of the bars of the walking track 5 to raise slightly, move forward slightly and then drop slightly, before returning to their original position. In this way, the case flats mounted on the walking track 5 are urged to move to the left slightly so that there is always a case flat at the front of the case flat magazine.

At the front of the walking track 5, there are positioned two case flat injectors 9. These injectors 9 drive one case flat upwardly onto the pin and dome combinations 11 which are mounted respectively on the inside jaws of the pair of pin erector jaws 10. The bottom edge of the two pin erector jaws 10 are curved upwardly to facilitate upwardly movement of the case flat onto the pin and dome combination 11 of the two jaws 10.

The pin erector jaws 10 are mounted on a vertical wheeled bogey 12. The bogey 12, by means of four circular V-grooved castors, can travel upwardly and downwardly on a V-edge vertical erector track 13. The pin erector jaws 10 are connected to the bogey 12 by means of parallel motion pivot bars 14.

Once a case flat has been injected rapidly upwardly onto the pins of the two pin erector jaws 10 (in closed parallel position), thereby forcing the top edges of the flat onto the pins, the two jaws 10 open so that rather than being parallel to one another, they are oriented at right angles to each other. In doing this they open the case flat into a rectangular pattern (as seen from the top). The opened case is shifted forwardly by the opening motion of the erector jaws 10 to a point where it can be lowered onto minor case flap rear tucker 16 and minor case flap front tucker 17. The open case is then lowered by vertical wheeled bogey 12 running down vertical erector track 13.

In FIG. 2, the minor flap front tucker 17 is shown in raised position. The slanted faces of minor flap tuckers 16 and 17 cause the minor flaps of the erected case to bend inwardly, and subsequently flat in a horizontal position. Shortly thereafter, major flap tuckers 18, one mounted on each side of the assembly line, cause the major flaps of the erected case to bend inwardly into a partially tucked position. Then, minor flap front tucker 17, being pivotally mounted, pivots downwardly to a horizontal position, to permit case transit pusher 15 to push the case forwardly (to the left) over glue head 20.

Not shown in FIG. 2 is the random glue switch sequencing system 19, which will be discussed in more detail later in this disclosure in association with the discussion of FIG. 21. The random glue switch system 19 determines the position of the case on the apparatus and signals the glue head 20 to spray cold adhesive according to a predetermined pattern onto the inside surfaces of the two partially opened major flaps of the case.

Once the adhesive has been applied, the case is pushed forwardly (to the left) so the major flaps move off the hold down fingers 18 and onto compression plate 22, between endless alignment belts 21. Mounted above compression plate 22 by means of support legs 23, is a case compression platen 24, which is affixed to a case compression mast 25. This unit is capable of travelling upwardly and downwardly by means of mast travel wheels 26. The platen 24 descends into the interior of the case resting on compression plate 22 and applies a strong force to the bottom major and minor flaps of the case, with sprayed cold adhesive therein, thereby rapidly adhering the flaps together. A strong force is applied to the top of the compression mast 25 by means of a high compression rocker 27 and compression booster 28.

Figure 3:
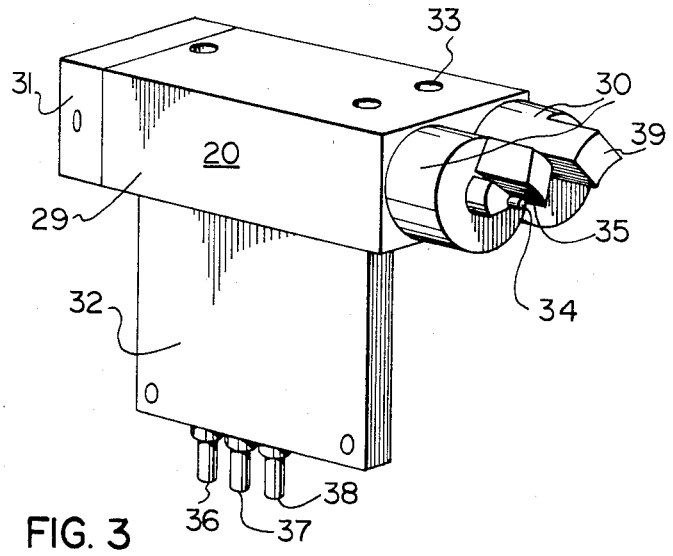
FIG. 3 represents a perspective view of the glue head.

FIG. 3 illustrates perspectively a detailed view of the glue head 20. The glue head 20 is constructed of a main body 29, which has mounted on the front thereof, a pair of 360° rotating nozzle heads 30. A cover plate 31 is secured to the rear of the main body 29. Main body 29, and cover plate 31 are affixed on a mounting and supply fin 32 by means of suitable screws and bolts through holes 33.

The rotating nozzle heads 30 are each constructed to have a glue jet and needle combination 34. A cross blower air nozzle 35 is positioned at right angles to glue jet needle 34, and proximate thereto. Glue for the glue head is supplied through glue supply port 36. Air for air nozzle 35 is supplied through air port 37. Air required to retract the needle in glue jet and needle 34 is supplied through air port 38.

Figure 4:
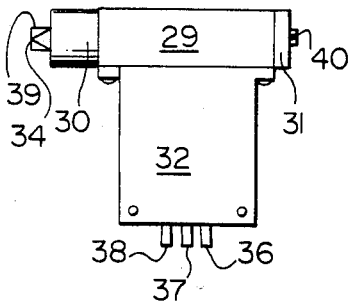
FIG. 4 represents a side elevation view of the glue head.

FIG. 4 represents a close to actual size side elevation view of the glue head 20, previously discussed in association with FIG. 3. One point that should be noted about the glue head shown in FIG. 4 is the presence of adjusting screw 40 which is located on the rear face of cover plate 31.

Figure 5:
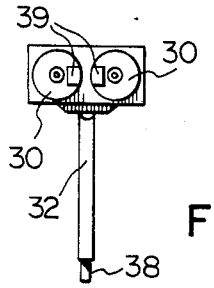
FIG. 5 represents an end elevation view of the glue head.

FIG. 5 illustrates an end elevation view of glue head 20. The small size of glue head 20 can be readily noted in FIGS. 4 and 5, which are shown in close to actual size. The diminutive size of glue head 20 and the fact that it is reliable in operation are believed to be major innovations and represent substantial advances over much larger and more cumbersome glue heads now used in case erector and sealing lines and equipment. Rotating nozzle heads 30, as shown in FIG. 5, are positioned to spray adhesive in opposite directions to one another, that is, horizontally to either side of the glue head 20. The cross blower air nozzle 35 for each nozzle 30 is carried in rotary air nozzle body 39 for each nozzle.

Figure 6:
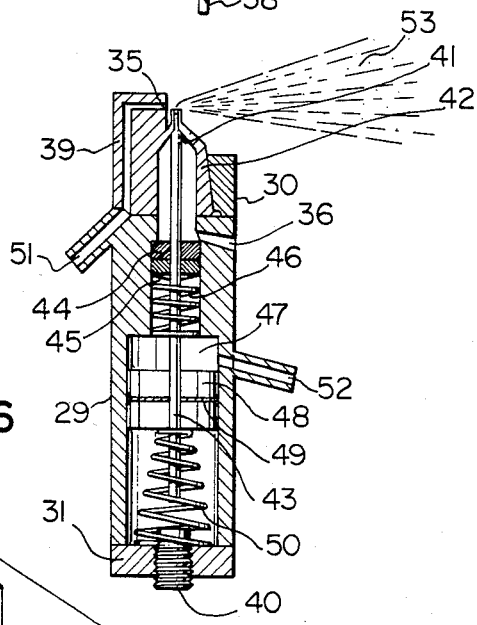
FIG. 6 represents a cut-away view of the internal components of the glue head.

FIG. 6 illustrates a cut-away, larger than actual size view of the glue head 20. The rotating nozzle 30 is shown at the top of the main body 29. The manner in which glue volume adjusting screw 40 fits within cover plate 31, is readily seen. Extending a substantial length within the body 29 is needle stem 43. At the top, needle stem 43 fits within nozzle cone 42. Needle stem 43 can move slightly upwardly or downwardly as required to enable glue to be ejected around the circumference of the needle 43. At the top, needle 43 is pointed and fits within seat 41 of cone 42. Needle stem 43 is mounted in place within body 29 by means of a series of seals comprising needle stem seals 44, brass seal retainer 45, seal pressure spring 46, piston 48 and piston seal 49. An air chamber 47 is located above piston 48. A variable spring 50 (piston return) is positioned below piston 48, and forces seal 48 upwardly.

In operation, glue (adhesive) is forced through glue inlet 36, into the chamber that exists between stem 43 and nozzle cone 42. Air from air cross blowing jet 35 is forced under pressure through air inlet 51. Air for purposes of depressing piston 48 is forced through piston operating air inlet 52.

When it is desired to operate the glue head 20, air is forced through air inlet 52, which depresses piston 48, which by being connected to needle stem 43 pulls needle stem from needle cone and seat 41. Simultaneously, glue under pressure as admitted through glue inlet 36, is forced between the annular space that is created between stem 43 and seat 41. If left alone, the glue emitted through nozzle 34 would be forced in a spray pattern vertically above the needle. However, since air is forced through air inlet 51, and is expelled at right angles to the direction of flow of the glue by means of cross blowing jet 35, the glue is forced to adopt a fan shaped pattern at right angles to the direction of flow of air through blowing jet 35. The considerable advantage of this arrangement is that the glue can be sprayed in a fine atomized fan shaped pattern, and because of the small size of the glue head 20, can be sprayed in confined spaces. Furthermore, the air blowing across the glue nozzle keeps it clean and ensures reliable operation.

Figure 7:
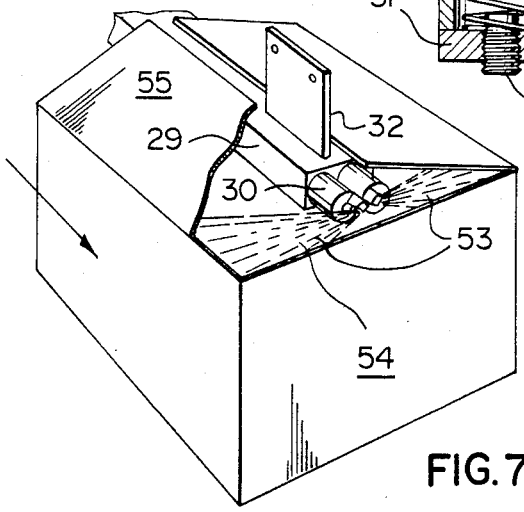
FIG. 7 represents a perspective view of the glue head spraying adhesive on the insides of the major flaps of a case.

FIG. 7 demonstrates in perspective view the manner in which the diminutive sized glue head 29, with the rotating pair of nozzles 30, by means of support fin 32, can pass between the small confined space that is created by having the major flaps 55 of a case 54 angled upwardly at only approximately 30 degrees. The rotating nozzles 30 enable the glue to be sprayed in any required direction. In the orientation shown, the glue is sprayed to each side of the glue head 20 in opposite directions. The spray pattern 53 assumes a fan shape in each case. A further advantage of this arrangement is that because the glue head is confined within the partially closed major flaps 55, very little of the glue escapes into the air. Thus coating-out of the glue on surrounding equipment is minimized. The direction of the travel of case 54 along the line is shown by an arrow.

Figure 8:
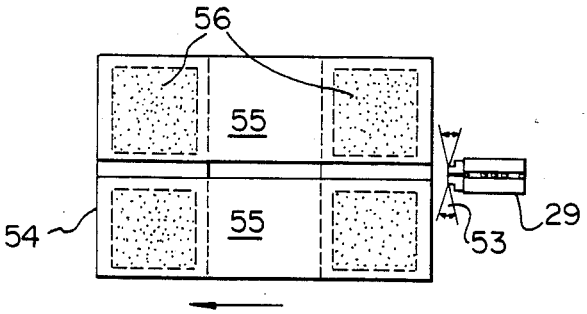
FIG. 8 represents a top elevation view of the major flaps of a case with adhesive sprayed thereon at four locations.

FIG. 8 illustrates how glue from the glue head 29 is sprayed in a fan-like pattern 53 from the pair of nozzles to apply four generally square areas of adhesive 56 at four locations on the major flaps 55 of the case 54. It is important to note that the glue is applied in the four areas so that a margin is left around the circumference of the four glue areas 56 to avoid overspray onto the exterior portions of the case, or surrounding equipment. The timing of glue application is governed by random glue switch 19 to be discussed in detail later in this disclosure in association with FIG. 21. Random glue switch 19 is very versatile and can sense various sizes of box, and ensure by sending appropriate electrical signals that glue is properly sprayed at predetermined points upon the interior surfaces of the major flaps of cases as they travel along the line.

FIG. 9 represents a perspective view of the major flap turning and hold down mechanism 18. The mechanism 18 is constructed of a pair of parallel finger-like prongs 57 extending from an axially rotatable cylindrical base 58, which is affixed to the frame 4, immediately ahead of the case magazine section. The case 54, after being erected by the pin erector jaws 10, and moved over the tuckers 16 and 17, is lowered with flaps down so that the two major flaps **55*b* extend downwardly between the two respective pairs of prongs 57**.

The manner in which a major flap 55 extends downwardly between the pair of prongs 57 is illustrated in end elevation view in FIG. **9*a*. The prongs 57 then rotate clockwise (as seen in FIG. 9*a*) approximately 90 degrees (see FIG. 9*b*), whereby the major flap 55 is turned inwardly and upwardly to an almost horizontal position. The prongs 57 and base 58 are rotated by an automatic rotating mechanism (not shown) mounted on the back of plate 4. The prongs 57, by in effect gripping the major flaps 55, hold the case 54 down and permit the pins 64 of the jaws 10 to be pulled upwardly out of the case. After the flaps 55 have been turned inwardly and upwardly, and the pins removed, the box pusher 15 pushes the case 54 along the apparatus over the glue and off the prongs 57**.

FIG. 10 illustrates in detail the construction of the erector jaws 10, pin and dome combination 11, wheeled bogey 12, and parallel motion side pivot arms 14. The entire assembly is capable of travelling upwardly and downwardly on vertical erector track 13 by means of V-grooved castors 67. These V-grooved castors 67 are rotationally mounted on the bogey 12 by means of four castor axles 69. The V-grooved castors 67 travel in pairs upwardly and downwardly on the pair of V-faced tracks 68. Upward motion of the bogey 12 is stopped at a predetermined point by pivot stop 80.

The pair of erector jaws 10 operate in clamshell manner about a pivot point from a position where they are proximate and parallel to one another to a position where they are at right angles to one another (as shown in FIG. 10). Mounted in linear series on the respective two interior faces of the pair of erector jaws 10 are a plurality of pin and dome combinations 11. While the number of pin and dome combinations can be varied as required as shown in FIG. 10, five pin and dome combinations 11 are positioned in a line on the main erector jaw 10, shown at the left side of FIG. 10, while three pin and dome combinations are positioned in a line on the right ejector jaw 10. The two pin and dome combinations 11 that are mounted in the region of the erector jaw 10 that is removed from the pivot point, have pairs of pins, while the three combinations 11 that are more proximate to the pivot point have single pins.

A pair of pins, rather than a single pin, provides better gripping action on a case which has been opened by means of the clam shell-like action of the pair of erector jaws 10. The two sides of the opened case that are not being held by the pair of erector jaws 10 create a bending moment on the two erector jaws 10, and this moment is better handled by having pairs of pins located at the remote wings of the erector jaws 10. Single pins are used in the interior where the grip need not be as strong.

Domes 61 are preferred because they guide the upper edges of the case flat easily and smoothly onto the sharp points of the needles. The pins 64 are mounted in pin retaining blocks 63. These pin retaining blocks 63 are held onto the erector jaws 10 at desired locations by means of pin block retaining screws 65. The sharpened points of the pins 64 are hardened by known metal hardening techniques, and carefully polished to ensure that they easily penetrate the edges of a corrugated cardboard box, without creating a substantial amount of resistance. This ensures trouble-free operation.

Relative orientation of the erector jaws 10 and the wheeled bogey 12 with one another is maintained by means of a set of four parallel motion side pivot arms 14. These arms 14 permit the erector jaws 10 to be moved from left to right and in reverse, as seen in FIG. 10, and thus permit the erected case to be opened from a closed flat position, and moved from right to left along the case erector and gluing line. The action of pivot arms 14 is controlled by side motion actuation dogs 71 which are located on the reverse side of the bogey 12. Dogs 71 are controlled by dog actuation bar 72, which moves upwardly and downwardly.

FIG. 10*a* illustrates a detailed side view of the relative orientation of pin 64 with dome 61, as mounted on jaw plate 10. The pin 64 can be removed for sharpening or replacement and is secured in pin block 63 by means of pin holding screw 66.

FIG. 11 illustrates by means of an enlarged view, the manner in which the edge of a corrugated Kraft cardboard piece 73 is guided by means of dome 61 onto the sharpened tip of needle 62. To enable efficient operation of the case erecting line, at high speed, it is extremely important that the edge of the corrugated board 73 of the case flat is guided precisely onto the sharpened tip of needle 62. This is accomplished by dome 61.

FIG. 12 illustrates in enlarged and exaggerated end elevation view the manner in which the alternating positioning of domes 61, and pins 62, on each of the parallel opposing erector jaw faces 10, forces the edge of the corrugated cardboard 73 to be guided onto the tips of the series of pins 62 such that the edge of the cardboard 73 assumes a sine-wave pattern. This sine-wave pattern, in combination with the action of the plurality of domes 61, ensures that the edge of the corrugated cardboard 73 is injected onto the sharp tips of all of the plurality of pins 62. This ensures that the cardboard edge does not miss the hardened points, or is skewered only by some of the pins. It can be seen in FIG. 12 that the alternating dome and pin design permits various thicknesses of cardboard 73 to be handled by the pin 62 and dome 61 combination. This is done by clearance 74 that exists between the pin 62 and the face of the opposite erector jaw 10.

FIG. 13 reflects the prior art and illustrates the number of steps that are required in order to glue a case using conventional case gluing equipment. Using such equipment, it is necessary for the case to travel through four case (box) lengths before the major and minor flaps of the case can be compression sealed. Furthermore, the process is energy consumptive because not only must the case pass through four case lengths in order to be glued, but also the major flaps of the case must be folded, completely opened and closed during the sequence.

FIG. 14 shows the marked contrast in distance, time, and technique that is possible with the applicant's case gluing system, when compared to the conventional method illustrated in FIG. 13. An important distinction is that the major flaps of the case, in the applicant's process, need not be fully opened and closed in order to be glued. This is because of the unprecedented diminutive size of the applicant's glue head (which heretofore was not thought possible), and the extremely efficient glue spraying pattern that can be created by the applicant's glue head 20.

The method whereby a flat case is taken from a magazine of case flats, opened into a rectangular case shape, folded to tuck the underlying minor and major flaps of the case, glue-sprayed and then compression sealed is illustrated sequentially in FIGS. 15 through 20.

As can be seen in FIG. 15, walker bar 5 continually moves the case flats (blanks) so that the front case flat (the left-most case flat) abuts case flat injector 9. Injector 9, by means of injector cylinder 75, upon automatic command, injects upwardly a single case flat into the space between the two parallel erector jaws 10 onto the pins that are mounted between the two jaw faces (as seen in enlarged detail in FIG. 12). Then, as seen in FIG. 16, the pair of erector jaws 10, by means of parallel motion pivot bars 14, move the case flat box and themselves away from the magazine of case flats 76 and, at the same time, open to a point where they are at right angles to one another. In this manner, the case is simultaneously moved away from the magazine of case flats 76 and is opened into a rectangular orientation (when viewed from above or below) to a point where the opened case 54 is positioned immediately above minor flap tuckers 16 and 17.

In FIG. 16, fold down front minor flap tucker 17 is raised upon command by means of air cylinder 78, and subsequently, when case 54 is moved down the line, air cylinder 78 operates to pull flap tucker 17 downwardly to a horizontal position, thereby enabling case 54 to pass over it (see FIG. 17).

As seen in FIG. 17, case 54, by means of bogey 12, which travels downwardly on vertical erector track 13, descends upon minor flap tuckers 16 and 17 to thereby fold the two minor flaps of the case 54 inwardly and upwardly. Then, as seen in FIG. 18, the pair of rotatable major flap tuckers 18, with prongs 57 grip the major flaps 55 on either side of case 54. The two pairs of prongs 57 rotate and tuck the two major flaps 55 of the case inwardly and slightly upwardly to a point where the major flaps are within approximately 30 degrees of being completely folded horizontally against the bottom side of the case 54. At the same time, because the case 54 is being held down by rotated prongs 57, the pair of erector jaws 10, and pins, can be withdrawn upwardly from the top edges of the case 54 by having bogey 12 ride upwardly on vertical erector track 13. At that point, box pusher 15 comes into play and pushes case 54 in a leftwardly direction over glue head 20.

The positioning of glue head 20 can better be seen in FIG. 19. For illustration purposes only, glue head 20 is shown as spraying adhesive in a fan-like pattern laterally to either side from two nozzles. In actuality, adhesive is not sprayed by the glue head 20 until it is completely housed within the major flaps 55 of case 54. This ensures that adhesive will not be sprayed at large on surrounding equipment. Timing for the spray of adhesive from glue head 20 onto the interior surfaces of the major and minor flaps is determined by random glue switch 19, which by means of sensors detects the leading edge of case 54, permits it to proceed along the line a small further distance, and then signals glue head 20 and its air supply to spray adhesive inside the two major flaps. The preferred adhesive pattern is four separate rectangular patches of glue on the major and minor flaps as illustrated and discussed previously in association with FIG. 8.

After passing over glue head 20 and having been properly sprayed with adhesive, the two major flaps 55 of case 54 are closed to a horizontal position by pushing the case 54 further to a position where it rests on compression plate 22. At this point, case 54 is directly under compression platen 24. Also, the case 54 is held between two parallel side mounted endless alignment belts 21 (see FIG. 2).

As seen in FIG. 20, compression platen 24, by means of vertical ram 25, is caused to descend downwardly within the interior of case 54 to a point where compression platen 24 touches the upper surfaces of the two minor bottom flaps of case 54. At this point, high pressure is applied to the top of vertical ram 25 by means of booster cylinder 28, which acts through rocker arm 27. This high pressure forces the interfaces of the major and minor flaps of case 54 tightly together and ensures that the flaps are glued securely together.

Following the application of high pressure by means of compression platen 24, vertical ram 25 moves upwardly to a point where the compression platen 24 is withdrawn above the upper regions of case 54. Case 54 is moved further down the line to a point where the case is pulled away by means of an outfeed belt 79. At that point, the case can be filled with appropriate consumer items such as cans, bottles, or the like.

FIG. 21 illustrates in side elevation view a detail of the random glue switch sequencer 19, which automatically determines the leading and trailing edges of the case 54 and regulates the turning on and off of the air and glue supplier to the glue head 20. A wheeled bogey 81 rides on central track 82 and is location oriented with box pusher 15. A front air switch 83 and a front glue switch 84 are mounted on a carrier that is connected to the case flat magazine rack. A back blowing air switch 85 and a back glue switch 86 are mounted on a second support that is affixed to the compression plate 22. The wheeled bogey 81 carries a glue carrier 87 which has thereon a glue cam 88 and an air cam 89.

In operation, the leading edge of the magazine location is determined by the adjustment position of box length adjusting handle 6. This determines the location of front air switch 83 and front glue switch 84. Thus, the distance between front switches 83 and 84 and back switches 85 and 86 will be related to the length of case 54. As the case 54 is pushed along by box pusher 15, the air cam 89 and glue cam 88, which move in unison with box pusher 15, first contact respectively switches 83 and 84, which in turn, by electrical signal means, cause glue head 20 to spray adhesive on the flaps 55 of case 54. The length of adhesive spray time is proportionately determined by the length of the glue cam 88 and the air cam 89. A longer length means a longer spray time, and vice versa. Glue cam carrier 87, during its travel along the track 82, after contacting switches 83 and 84, covers a distance where the cams contact no switches. Then, after travelling over this region, the carrier 87 approaches compression plate 22 whereupon cams 88 and 89 contact back blowing air switch 85 and back glue switch 86. This contact causes a second application of adhesive by glue head 20 to a second area of the flaps 55 (see FIG. 8). The glue spray actuation mechanism starts prior to the air flow and ceases prior to the air being turned off, which assists in keeping the glue head 20 clean and functioning efficiently.

The carrier 87 illustrated in FIG. 21 shows different lengths of cams above one another. Carrier 87 can be adjusted upwardly or downwardly in order to expose various lengths of cams to the air and glue switches, thereby regulating as required the length of adhesive spray time. As an alternative system, the cam length can be varied by constructing the cams in two parallel strips which can be moved relative to one another, thereby in effect providing a longer or shorter cam length, as required. Switches 83, 84, 85 and 86 can be inactivated, or the carrier 82 can be drawn back, on the return of carrier 87 to its original position, thereby preventing the spray of adhesive from glue head 20 when it is not wanted.

FIGS. 22 through 30 illustrate the construction and sequential operation of an alternative type of random glue switch sequencer 19. Basically, the random glue switch sequencer 19 comprises four electrical switches 91, 92, 93 and 94, arranged in a line that is parallel and adjacent to the path travelled by a case that is to be glued (indicated by the two double headed arrows). The four switches have four respective contact sensors 95, 96, 97 and 98. Each switch is connected in series to an electrical power supply 99 according to the circuit diagram shown in FIG. 22. The switches 91 to 94 are also connected to a solenoid actuated air valve 90 which in turn delivers compressed air to glue head 20 and causes it to spray glue as required.

As may be seen in sequence in FIGS. 23 through 30, the case 54, as it travels along the line as indicated by the arrow, first contacts switch 91 (FIG. 23) and then switch 92. Contact with these two switches does not activate solenoid actuated air valve 90 and hence no glue is sprayed on the major flaps of the case 54. However, when case 54 advances along the line to the point where it contacts switch 93 (FIG. 25) then valve 90 is actuated and glue head 20 commences to spray glue on the major flaps of case 54 (the second major flap and glue nozzle are not shown for simplicity of illustration). Glue continues to be sprayed on the case 54 until switch 94 is contacted. Then the air valve is turned off and glue spraying stops.

The case 54 proceeds further along the line until the end of case 54 leaves contact with switch 91 (FIG. 27). This activates the valve 90 a second time and glue head 20 commences to spray glue on the major flap of the case at a second location (see pattern shown in FIG. 8).

Glue head 20 continues to spray glue on the major flap (see FIG. 28) until the rear corner of case 54 advances to the point where it loses contact with switch 92. This de-activates air valve 90 and glue head 20 stops spraying glue. Case 54 then proceeds along the line, ultimately losing contact with switches 93 and 94 as well (see FIGS. 29 and 30). These two switches activate the air valve 90 only when contacted by the leading edge of case 54 and have no function when released by the rear edge of case 54.

This embodiment of random glue switch sequencer 19 requires a between case resetting mechanism (not shown) or a one-case length space between cases so that the sensors 85, 86, 87 and 88 can return to their original positions after being triggered.

The contact sensors 95, 96, 97 and 98 have sufficient length that they function properly even though there may be significant variations in the widths of the cases 54 that proceed in series along the line. To accommodate large differences in case widths, however, such as when the line is being converted from handling one width of case to handling another width of case, the position of the overall random glue switch sequencer 19 can be moved inwardly or outwardly, as required. Further, the relative lengths and distances between the glue sprayed areas can be adjusted as required by varying the distances between the four switches 91, 92, 93 and 94.

FIG. 31 illustrates in perspective view an alternative apparatus for holding the case 54 downwardly by means of a pair of transit bars 155 positioned over minor front flap tucker 17. The case 54 is gripped by means of hold down strips 57, mounted on the interior sides of the two transit bars 155. As can be recognized, when the bottom major and minor flaps of the case are forced to bend inwardly, a substantial amount of upward force is exerted on the case 54. This force attempts to drive case 54 upwardly which is detrimental to proper functioning of the line. This force can be resisted by means of hold down strips 157. Hold down strips 157, in association with retaining bars 155, are mounted in a self-correcting manner about pivot point 158. Retaining transit bars 155, together with hold down strips 157, can be moved inwardly or outwardly in a lateral direction from each side of case 54. This can be done by actuated bars or some other acceptable known technique.

In FIG. 31, one of the major flaps 55 is shown in a vertical downwardly orientation. This is for illustration purposes only. In operation, the two major flaps are bent inwardly by the fingers of major flap tuckers and hold downs 19 which pivotally rotate inwardly and upwardly as required.

FIG. 31*a* shows in detail the way that the pair of hold down strips 57 are mounted within retaining bar 155 by means of rubber retaining rings 160.

As will be apparent to those skilled in the art in the light of the foregoing disclosure, many alterations and modifications are possible in the practice of this invention without departing from the spirit or scope therof. Accordingly, the scope of the invention is to be construed in accordance with the substance defined by the following claims.

The embodiments of the invention in which an exclusive property or privilege is claimed are defined as follows:

1. A method of gripping a penetratable case flat on a case erecting apparatus which comprises impaling an edge of the flat with a sharp pin which extends into the flat between and parallel to the two outside surfaces forming the flat, wherein the case flat is constructed of corrugated cardboard and the pin extends into one of the spaces formed by the corrugation of the cardboard.

2. A method of holding and erecting a rectangular shaped case from a case flat comprising:

(a) ejecting the case flat from a magazine of case flats in a manner such that two edges of the case flat are impinged respectively upon at least two article impaling means, one of the impaling means being mounted on a first support means, and the second of the impaling means being mounted on a second support means, the two support means being parallel to one another, with the first and second impaling means on the first and second support means facing one another, the first and second support means being pivotally movable in relationship to one another;

(b) the two edges of the case flat once being respectively impinged and gripped on the first and second impaling means, being pivotally opened from the parallel closed position of (a) to a position where the sides of the cases are at right angles to one another, by pivotally opening the first support means and the second support means so that they are at right angles to one another.

3. A method according to claim 2 wherein the case once opened is moved away from the case flat magazine.

4. A method according to claim 2 or 3 wherein the support means can be raised or lowered in relation to the case flat magazine.

5. A method according to claim 2 wherein flaps of the erected case are subsequently adhesively sealed by applying cold liquid adhesive on either or both of the interior surfaces of major and the exterior surfaces of minor flaps of the case while the major flaps are in only a slightly raised position, utilizing a liquid adhesive applicator means which can penetrate into the space between the slightly raised major flaps and closed minor flaps of the case body and apply liquid adhesive onto either or both of the interior surfaces of the major and the exterior surfaces of the minor flaps of the case.

6. A method according to claim 2 wherein the interior surfaces of major flaps and exterior surfaces of the minor flaps of the erected case are sprayed with adhesive comprising:

(a) first electric sensing means being capable of detecting the leading edge of a case as it moves laterally past the first electric switching means;

(b) a second electric sensing means arranged in a path with the first electric sensing means parallel to the path of travel of the case, the second sensing means being capable of detecting the leading edge of the case as it moves laterally past the second electrical sensing means;

(c) a third electric sensing means arranged in a path with the first and second electric sensing means, parallel to the path of travel of the case, the third sensing means being capable of detecting the leading edge of the case as it moves laterally past the third sensing means, the third sensing means being connected to an electrical power supply, the third sensing means sending an electrical signal to a solenoid which upon receiving the signal actuates an air valve which in turn actuates a liquid adhesive spray means which commences to spray adhesive upon either or both of the interior surfaces of the major and the exterior surfaces of the minor flaps of the case;

(d) a fourth electrical sensing means arranged in a path with the first, second and third electrical sensing means parallel to the path of travel of the case, the fourth electrical sensing means being capable of detecting the leading edge of the case as it moves laterally past the fourth sensing means; the fourth sensing means being connected to an electrical power supply and upon sensing the leading edge of the case, emits an electrical signal to the solenoid which deactivates the solenoid, which in turn stops further spraying of liquid adhesive on the flaps of the case;

(e) the first electrical signal (a), upon detecting the trailing edge of the case as it moves laterally by the row of electrical sensors, being connected to an electrical power supply source, emitting a signal to the solenoid thereby causing the solenoid to activate an air valve, which in turn causes the adhesive head to spray adhesive on either or both of the interior surfaces of the major and the external surfaces of the minor flaps of the case at a second location; and (f) the second electrical sensor (b) upon detecting the trailing edge of the case as it moves laterally by the row of electrical sensors being connected to an electrical power supply source, emitting a signal to the solenoid, which thereby deactivates the solenoid, and in turn stops the spraying of adhesive upon the flaps of the case.

7. An apparatus for gripping sheet material on a case erecting apparatus comprising:

(a) a support means having a raised surface thereon; and (b) article impaling means extending to the raised surface for impaling each of at least two edges of the sheet material and holding the sheet material against the raised surface, the article impaling means including one end secured against to the raised surface, and a free end spaced above the raised surface, wherein the article impaling means is secured to the support means by a retaining block.

8. An automatic case erecting and sealing apparatus comprising:

(a) means for receiving a case flat from a supply of case flats;

(b) means for penetrating each of at least two edges of the case flat, thereby gripping same;

(c) means for causing the penetrating means to move the case flat wherein the penetration means opens the case flat while it is moving the case flat; and (d) a random glue switch means which can determine the front or trailing edge of a case as it is moved along the apparatus, and regulate the spray time and location of adhesive spray on the flaps of the case.

9. An apparatus according to claim 8 which includes minor flap tucker means for first tucking the minor flaps of an erected case, and major flap tuckers for tucking the major flaps of the erected case after the minor flaps have been tucked.

10. An apparatus according to claim 9 which includes two pairs of rotatable fingers, one pair positioned on each side of the apparatus, each pair serving to grip the two major flaps of the case and holding the case down as the pins are withdrawn from the case.

11. An automatic case erecting and sealing apparatus comprising:

(a) means for receiving a case flat from a supply of case flats;

(b) means for penetrating each of at least two edges of the case flat, thereby gripping same;

(c) means for causing the penetrating means to move the case flat; and (d) means for adhesive spraying the interior surface of at least one flap of the case without causing the flap to be completely open relative to the case body.

12. An apparatus according to claim 11 which includes a pressure applicator for applying pressure to seal a case flap once the interior surface thereof has been sprayed with adhesive.

13. An apparatus for gripping and erecting case flats, taken from a magazine of case flats, comprising:

(a) at least two sharp, pointed protrusions, one mounted on one support means, the second mounted on a second support means, the two support means being pivotally arranged in association with one another whereby the two support means can move from a closed position where the two support means are parallel to one another, to a position where the two support means are at right angles to one another; and (b) means for removing one case flat from the case flat magazine and causing the two protrusions to penetrate into two respective edges of the case flat, one protrusion being forced into one edge of the case flat, and the second protrusion being forced into the second edge of the case flat.

14. An apparatus according to claim 13 wherein respective guide means are mounted on the first and second support means and are respectively located immediately ahead of the sharp points of the two protrusions.

15. An apparatus according to claim 13 wherein the protrusion is a pair of sharp pointed pins arranged in parallel orientation to one another and of approximately equal distance, the points extending in the same direction, with a dome positioned immediately below the sharp points of the pair of pins, the height of the dome being slightly less than the height of the points above the support means.

16. An apparatus according to claim 13, 14 or 15 wherein the protrusion means comprises at least two sets of pins supported on the first support means, and at least two pairs of pins are supported on the second support means.

17. An apparatus according to claim 13 wherein the protrusion means and the support means are mounted on a movable means whereby the protrusion means and support means can be moved towards or away from the case flat magazine.

18. An apparatus according to claim 13 wherein the protrusion means and support means can be moved upwardly and downwardly as well as towards or away from the case flat magazine.

19. An apparatus according to claim 9 or 10 wherein the protrusion means and support means are mounted on the movable means such that one support means remains parallel to the moving means as the support means is moved upwardly or downwardly.

20. An apparatus according to claim 13 including an adhesive spray apparatus comprising:

(a) adhesive nozzle means for spraying liquid adhesive onto at least one flap of the case flat; and (b) air nozzle means mounted proximate to and at right angles to the direction of adhesive emission from the adhesive nozzle spray means whereby adhesive emitted from the adhesive nozzle is caused by air emitted from the air nozzle to spray at right angles to the nozzle.

21. An apparatus according to claim 20 wherein the adhesive spray air nozzle is rotatable.

22. An apparatus according to claim 12 wherein a pair of adhesive nozzle means and a corresponding pair of air nozzles, in combination, are mounted on one support body.

23. An apparatus according to claim 12 wherein the nozzle mounting means is affixed to a thin mounting and supply fin.

24. An apparatus according to claim 12 wherein the nozzle mounting means is mounted on a thin mounting and supply fin which has therein a plurality of distinct channels which can be used respectively to supply liquid adhesive and air respectively to the adhesive nozzles and the air nozzles.

25. An apparatus according to claim 12 wherein the apparatus includes on-off adhesive and air actuator means for starting and stopping the flow of liquid adhesive from the nozzle and the emission of air from the air nozzle.

26. An apparatus according to claim 10 including at least two switches, the switches having sensors mounted thereon, the sensors being capable of detecting the leading and trailing edges of objects as they pass by the switches, the pair of switches, upon being activated by the sensors, respectively emitting an electrical signal by being connected to an electrical power source, and a sensor activating means associated with the orientation of the case, whereby the case, upon being moved along the apparatus, moves the activating means, which in turn triggers the sensor of the switch.

27. An apparatus according to claim 18 wherein the switches are connected electrically to a solenoid actuation means, which activates an air valve, which then delivers compressed air to a glue head, the glue head being capable of spraying liquid adhesive onto the case.

28. A method of gripping a penetratable flat or erected flat on a case erecting apparatus which comprises impaling an edge of the flat with a sharp pin which extends into the flat between and parallel to the two outside surfaces forming the flat wherein the flat is constructed of corrugated cardboard and the pin extends into one of the spaces formed by the corrugation of the cardboard.

29. A method of gripping a penetratable flat or erected flat on a case erecting apparatus which comprises impaling an edge of the flat with a flat impaling means which extends into the flat between and parallel to the two outside surfaces forming the flat, wherein the flat is constructed of corrugated cardboard and the flat impaling means extends into one of the spaces formed by the corrugation of the cardboard.

30. An automatic case erecting and sealing apparatus comprising:

(a) means for receiving a case flat from a supply of case flats;

(b) means for penetrating at least two edges of the case flat, thereby gripping same;

(c) means for causing the penetrating means to move the case flat wherein the penetration means opens the case flat while it is moving the case flat; and (d) a random glue switch means which can determine the front or trailing edge of a case as it is moved along the apparatus, and regulate the application time and location of adhesive application on the flaps of the case.

31. An automatic case erecting and sealing apparatus comprising:

(a) means for receiving a case flat from a supply of case flats;

(b) means for penetrating at least two edges of the case flat, thereby gripping same;

(c) means for causing the penetrating means to move the case flat; and (d) means for applying adhesive to the interior surface of at least one flap of the case without causing the flap to be completely open relative to the case body.

* * * * *

UNITED STATES PATENT AND TRADEMARK OFFICE

CERTIFICATE OF CORRECTION

PATENT NO. : 4,553,954

DATED : December 27, 1985

INVENTOR(S) : Peter C. Sewell et al

It is certified that error appears in the above-identified patent and that said Letters Patent is hereby corrected as shown below:

Claim 7, column 17, line 1, delete "against" and replace with --adjacent--.

Signed and Sealed this

*Twenty-fifth* Day of *February 1986*

[SEAL]

*Attest:*

DONALD J. QUIGG

*Attesting Officer*

*Commissioner of Patents and Trademarks*